United States Patent [19]

Nagatsuna

[11] Patent Number: 4,989,037

[45] Date of Patent: Jan. 29, 1991

[54] DEVICE FOR DRIVING A ROTARY BODY

[75] Inventor: Shinji Nagatsuna, Tokyo, Japan

[73] Assignee: Ricoh Company, Ltd., Tokyo, Japan

[21] Appl. No.: 373,173

[22] Filed: Jun. 29, 1989

[30] Foreign Application Priority Data

Jun. 30, 1988 [JP] Japan ..... 63-85754

[51] Int. Cl.[5] ..... G03G 15/06

[52] U.S. Cl. ..... 355/200; 355/251; 355/259; 355/219; 355/271; 101/216; 100/172

[58] Field of Search ..... 355/245, 251, 259, 260, 355/200, 202, 210, 211, 213, 133, 253, 219, 271, 282; 101/216, 247; 118/656–658; 100/168, 169, 171, 172, 176

[56] References Cited

U.S. PATENT DOCUMENTS

| | | | |
|---|---|---|---|
| 3,931,792 | 1/1976 | Sato | 355/246 X |
| 4,271,786 | 6/1981 | Buckley et al. | 355/245 X |
| 4,339,196 | 7/1982 | Beck et al. | 355/245 X |
| 4,615,605 | 10/1986 | Kida et al. | 355/245 X |
| 4,845,523 | 7/1989 | Miyaji | 355/211 |
| 4,891,674 | 1/1990 | Seyfried | 355/251 X |

*Primary Examiner*—R. L. Moses

*Attorney, Agent, or Firm*—Oblon, Spivak, McClelland, Maier & Neustadt

[57] ABSTRACT

A driving device drives an elongate second rotary body which is movable toward and away from an elongate first rotary body that is mounted on a machine body, while maintaining the former in contact with the latter in a uniform pressure distribution. Both of the first and second rotary bodies have a cylindrical or columnar configuration, for example. The device transmits a rotating force from a drive source to the second rotary body at one end of the second rotary body. The second rotary body is unmovably mounted on a carrier or base integrally with the drive source and is movable toward and away from the first rotary body. Biasing means constantly urges the second rotary body against the first rotary body.

10 Claims, 8 Drawing Sheets

DEVICE FOR DRIVING A ROTARY BODY

BACKGROUND OF THE INVENTION

The present invention relates to a device for driving a rotary body and, more particularly, to a device for driving a second rotary body which is movable toward and away from a first first rotary body that is mounted on a machine body by transmitting a rotating force from a drive source to one end of the second rotary body, while maintaining the second rotary body in pressing contact with the first rotary body in a uniform pressure distribution. Both of the first and second rotary members to which the present invention is applicable may have an elongate cylindrical or columnar configuration.

A driving device of the type described is incorporated in various kinds of machines. With an electrophotographic copier, printer, facsimile machine or similar image forming apparatus, for example, it is a common practice to hold an image carrier in the form or a drum, or first rotary body, in pressing contact with a developing roller, or second rotary body. The above-described type of driving device drives the developing roller in a rotary motion. In this kind of application, it is often required that the first and second rotary bodies be pressed against each other in a uniform pressure distribution along their axes. Specifically, an image forming apparatus has a developing roller (second rotary body) and an image carrying drum (first rotary body) which are pressed against each other. While the roller and drum are individually rotated, a latent image electrostatically formed on the drum is developed by a toner and the resulting toner image is transferred to a paper sheet. This kind of development is generally referred to as contact development. To insure stable and high-quality development of the latent image, it is preferable that the roller and drum be pressed against each other by a constant pressure which is not excessively high or excessively low. This may be implemented on the assembly line by positioning the roller and drum accurately parallel to each other and mounting them on the body of the apparatus rotatably but unmovably otherwise.

In general, however, the developing roller and drum have peripheral surfaces which are somewhat eccentric relative to their axes of rotation or not accurately parallel to the latter or even undulated, due to errors and other causes particular to the production line. Hence, the parallelism of the roller and drum achievable in practice is limited. It follows that maintaining the roller and drum in contact in a uniform pressure distribution which is not excessively high or excessively low along their axes is extremely difficult. One possible approach for eliminating this difficulty is to mount the roller in such a manner as to be movable toward and away from the drum which is unmovable, and to urge the roller against the drum by biasing means which may comprise springs, as proposed in the art. This scheme is successful in insuring a uniform pressure distribution between the roller and the drum despite the previously stated defects particular to the peripheral surfaces of the roller and drum.

Usually, the developing roller is driven by a device which is composed of a gear or similar transmitting member mounted on one end of the roller, a drive gear securely supported by the machine body and meshed with the transmitting member, and a drive motor mounted on the machine body for driving the drive gear. However, when a driving force is applied to only one end of the roller and the developing roller is movably supported as previously stated, a force which is deviated by the pressure angle from the common tangent of the two gears, i.e., a so-called tangential force acts on the driven end of the roller only. In this condition, the pressure which the roller exerts on the drum differs from one end where the tangential force acts to the other end, tending to disturb the uniform contact of the roller and drum in the axial direction. This problem may be eliminated by elaborating the position of the gear mounted on the developing roller or by using an Oldham's coupling, as disclosed in Japanese Utility Model Publication No. 59-26373 by way of example. Such a scheme, however, often fails to achieve the expected advantage when the torque of the developing roller is large or when individual components have scattering as to the position due to errors introduced in the assembly of the gears and coupling.

The undesirable occurrence discussed above is observed with various kinds of machines or various portions when, for example, the second rotary body in the form of a charging roller or similar roller is pressed against the first rotary body in the form of an image carrying drum or when the first rotary body of an offset printer which is an offset roller is pressed against the second rotary body in the form of an ink roller. This is also true with an arrangement wherein spacer rollers mounted on the second rotary body are pressed against the first rotary body and an arrangement wherein another form of torque transmission device is used.

SUMMARY OF THE INVENTION

It is therefore an object of the present invention to provide a device for driving a rotary body which eliminates the drawbacks particular to the prior art devices as discussed above.

It is another object of the present invention to provide a device which imparts a rotating force to an elongate cylindrical or columnar second rotary body while maintaining a uniform pressure distribution between the second rotary body and an elongate cylindrical or columnar first rotary body along the axes of the rotary bodies.

It is a further object of the present invention to provide a generally improved device for driving a rotary body.

A device for driving a rotary body in a rotary motion by transmitting a driving force from a drive source to the rotary body of the present invention comprises a first rotary body rotatably supported by a body of a machine, a second rotary body movable toward and away from the first rotary body integrally with the drive source, the driving force being applied to one end of the second rotary body, and biasing means for causing the second rotary body into pressing contact with the first rotary body.

BRIEF DESCRIPTION OF THE DRAWINGS

The above and other objects, features and advantages of the present invention will become more apparent from the following detailed description taken with the accompanying drawings in which:

FIG. 7 is a section along line VII—VII of FIG. 2, showing the copier together with guide members and the like;

DESCRIPTION OF THE PREFERRED EMBODIMENT

A preferred embodiment of the device for driving a rotary body in accordance with the present invention will be described with reference to the accompanying drawings. In the illustrative embodiment, a first and a second rotary body are respectively implemented as a photoconductive drum and a developing roller of an image forming apparatus by way of example. The photoconductive element serves as an image carrier for forming an electrostatic latent image image thereon.

Figure 1:
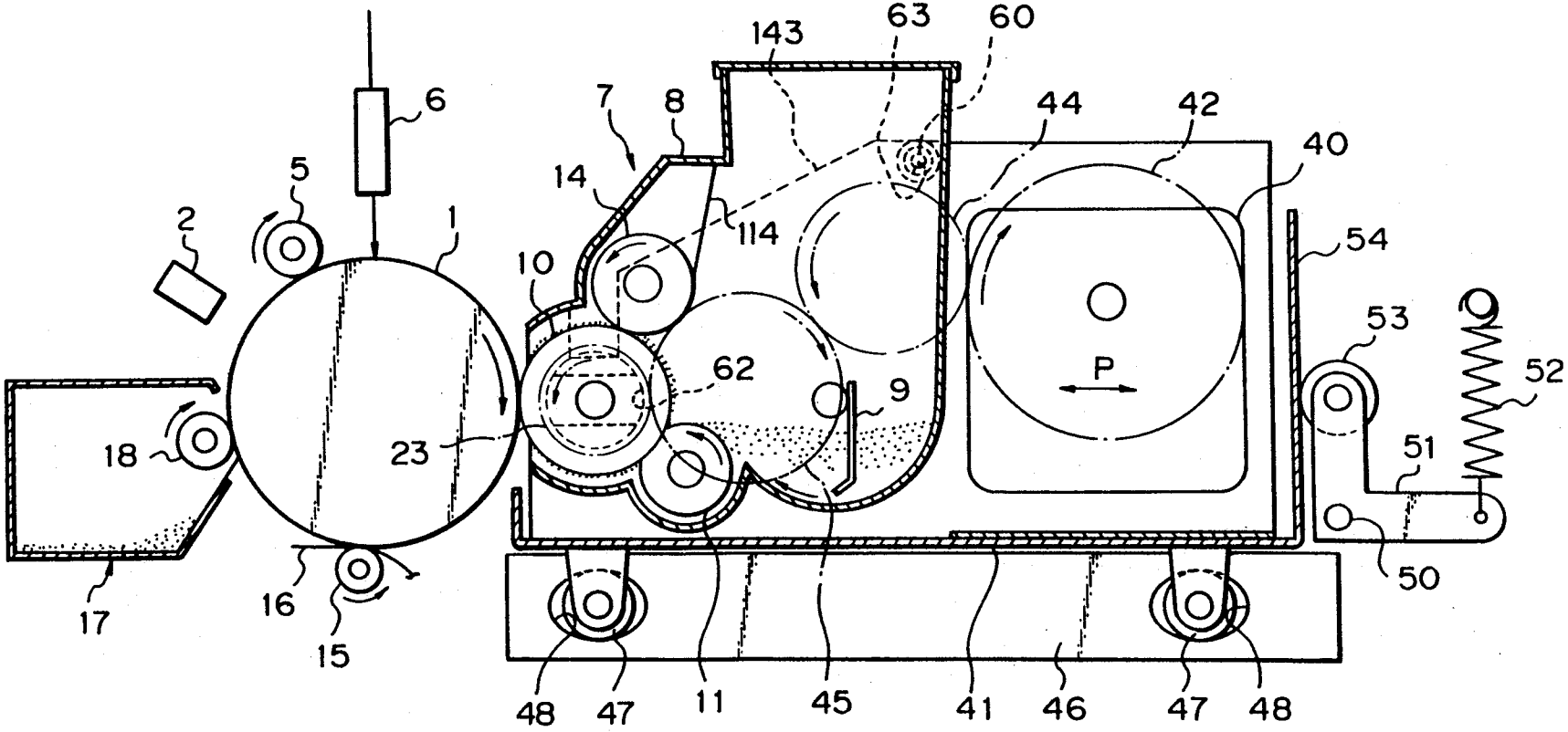
FIG. 1 is a sechematic section of an electronic copier to which the present invention is applied.
Figure 2:
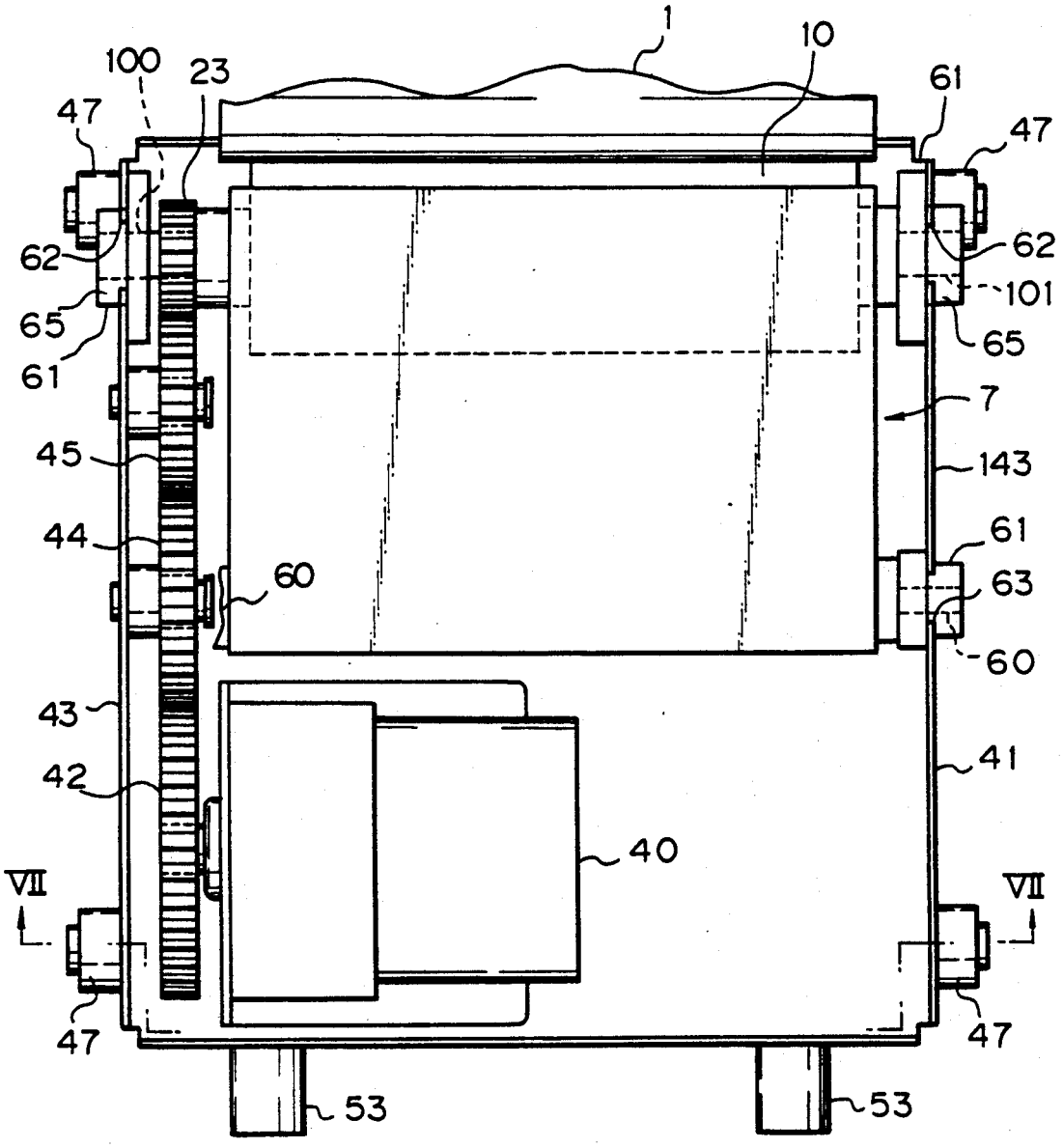
FIG. 2 is a fragmentary plan view of the copier shown in FIG. 1.

Referring to FIGS. 1 and 2, an image forming apparatus in the form of an electronic copier has a body which supports a photoconductive drum 1 rotatably but not movably otherwise. A driving mechanism, not shown, rotates the drum 1 clockwise as viewed in FIG. 1 while a charging roller 5 charges the surface of the drum 1 to a predetermined polarity. An imagewise reflection from an original document (not shown) if focused by optics 6 onto the charged surface of the drum 1 to form an electrostatic latent image thereon. A developing unit 7 develops the latent image to produce a toner image when the latent image passes it.

A developing unit 7 has a toner container 8 which stores a toner therein, an agitator 9 for agitating the toner inside the container 8, a developing roller 10, a toner supply roller 11 for supplying the toner to the roller 10, and a regulating roller 14 for regulating the thickness of a toner layer. Extending parallel to the drum 1, the above-mentioned components 9, 10, 11 and 14 are supported by the toner container 8 rotatably but not movably otherwise and are individually rotated as indicated by arrows in the FIG. 1. The toner supply roller 11 has a surface layer made of foaming polyurethane or similar elastic material and is pressed against and elastically deformed by the developing roller 10. The agitator 9 agitates the toner in the toner container 8 constantly and slowly to prevent it from blocking, while urging the toner toward the toner supply roller 11. The toner supply roller 11 rotates in a direction for counteracting the developing roller 10 to scrape off the toner which has been used for development from the roller 10, while supplying the fresh toner being stored in the toner container 8. The regulating roller 14 rotatably supported by the toner container 8 regulates the toner being deposited on the developing roller 10 to form a thin uniform toner layer. While so doing, the regulating roller 14 charges the toner to a predetermined polarity by friction.

The developing roller 10 rotated as indicated by the arrow transports the charged toner to a developing region where the drum 1 and developing roller 10 are held in pressing contact. In the developing region, the toner is electrostatically deposited on the drum 1 which carries the latent image thereon, whereby the latent image is developed to become a toner image. An image transfer roller 15 transfers the toner image from the drum 1 to a paper sheet 16 which is fed to the drum 1. The paper sheet 16 is then driven toward a fixing unit (not shown) to fix the toner image thereon. A scraper blade 114 is supported at one end by the toner container 8 so as to scrape off the toner from the regulating roller 14. A cleaning unit 17 has a cleaning roller 18 removes the toner remaining on the drum 1 after the image transfer. A discharger 2 dissipates the charge on the drum 1 which has been cleaned by the cleaning roller 18.

The developing roller 10 is held in contact with the drum 1 for developing a latent image, as stated above. With this kind of development, a toner image of high quality cannot be achieved stably unless the developing roller 10 is pressed against the drum 1 in a uniform pressure distribution as far as possible along the axis of the roller 10. Should the pressure be locally excessively low or excessively high, the toner image would be locally lost or lack a uniform density distribution or the background would be smeared. Further, excessively high pressures would aggravate the wear of the drum 1 and thereby reduce the lifetime of the drum 1.

Figure 3A:
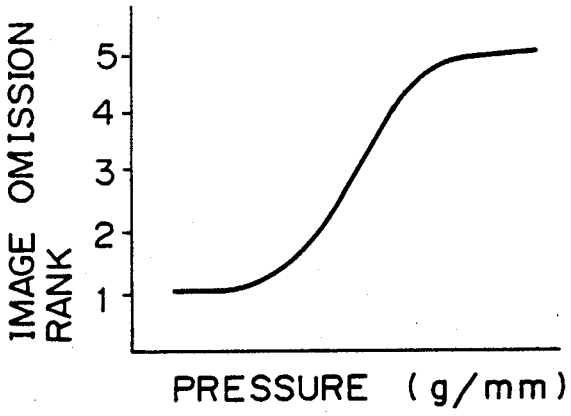
FIGS. 3A to 3C plot specific relationships between the pressure acting between a developing roller and a photoconductive drum and the image quality.
Figure 3B:
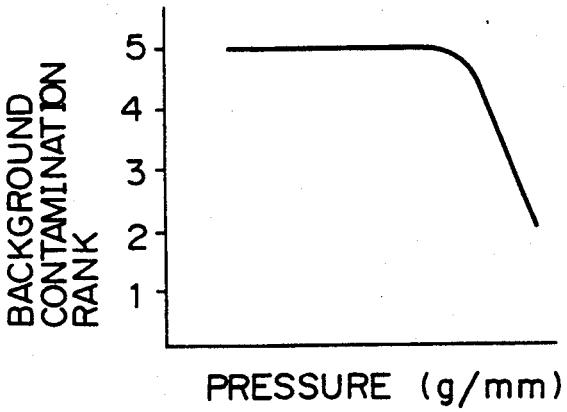
Figure 3C:
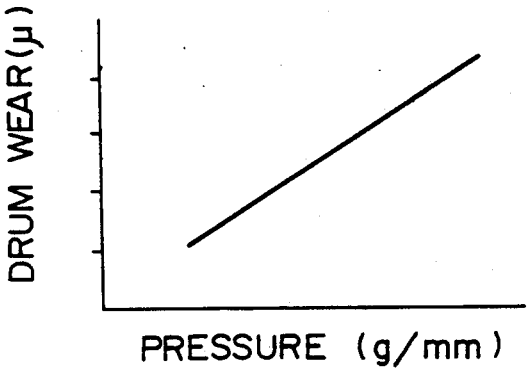

FIGS. 3A, 3B and 3C plot respectively the omission of an image, the contamination of background and the wear of the drum 1, with respect to the above-stated pressure. As these plots also indicate, the contact pressure has to be maintained in a uniform distribution along the axis of the developing roller 10 and within a certain range. To meet this requirement, the copier shown in FIGS. 1 and 2 has the developing roller 10 being supported to be movable toward and away from the drum 1, basically as is case with the prior art construction. The developing roller 10 is driven in a rotary motion by a driving device having a gear 23 mounted on one side thereof, i.e., on a developing roller shaft 100 in the illustrative embodiment. In this construction, a rotating force is applied to the developing roller 10 at one end of the latter.

Figure 4:
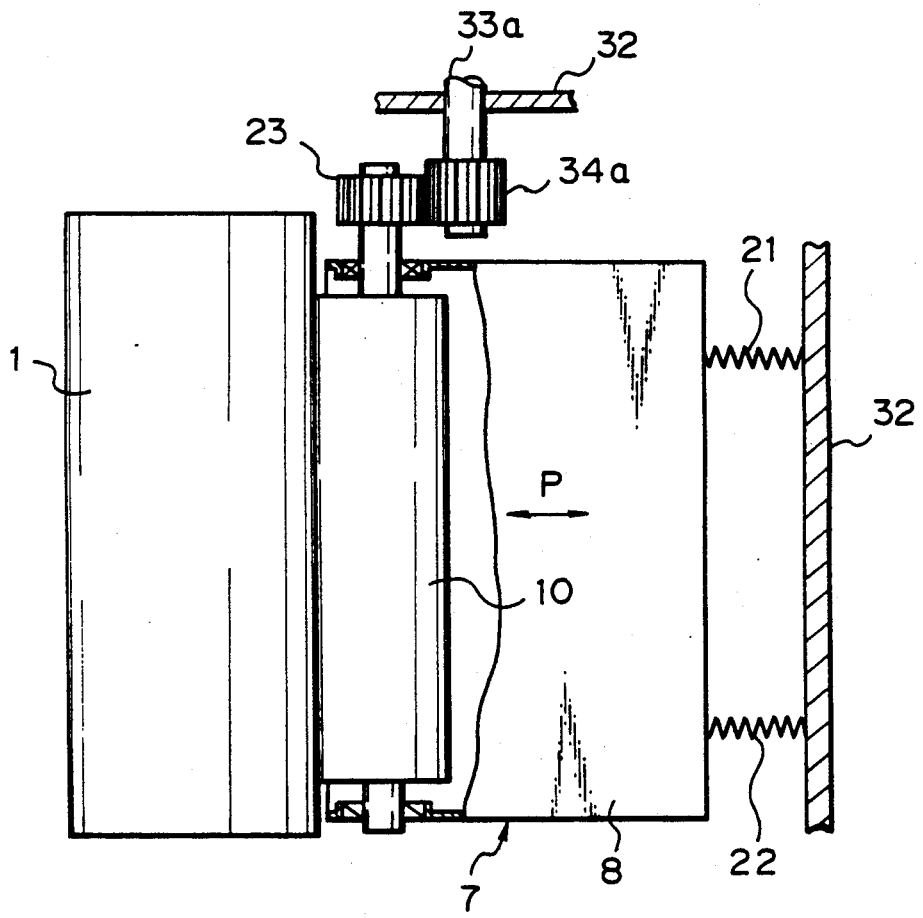
Fig. 4 PRIOR ART
FIG. 4 is a fragmentary section showing a prior art developing unit and a device for driving it.
Figure 5:
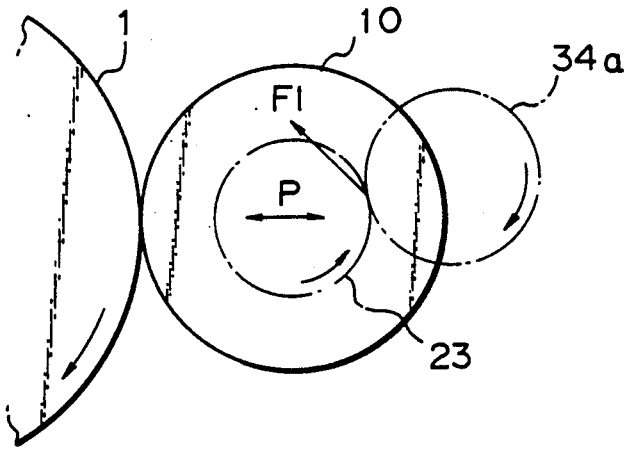
Fig. 5 PRIOR ART
FIGS. 5 and 6 are diagrams useful for understanding drawbacks of the prior art driving device.

To better understand the driving device of the illustrative embodiment and constructions associated therewith, drawbacks particular to a prior art construction having the developing roller 10 pressing against the drum 1 will be described specifically. As shown in FIGS. 4 and 5, a specific prior art construction has the developing unit 7 which is movable relative to the drum 1 as indicated by an arrow P. The toner container 8 is constantly biased toward the drum 1 by compression springs 21 and 22 which are anchored to the container 8 and a structural member 32 of the copier body at opposite ends thereof. Hence, the developing roller 10 rotatably supported by the toner container 8 elastically presses itself against the drum 1 while being movable toward and away from the drum 1. When the periphery of the developing roller 10 or that of the drum 1 is somewhat eccentric, when the parallelism of the roller 10 and drum 1 is slightly inaccurate, or when the circularity of the roller 10 has some error, the roller 10 and drum 1 are allowed to contact each other with a uniform pressure along their axes. This is advantageous over the configuration wherein the roller 10 is mounted on the copier body unmovably.

The gear 23 associated with the developing roller 10 is supported by the structural member 32 of the copier body and held in mesh with a drive gear 34*a* which is mounted on a drive shaft 33*a*. The drive shaft 33*a* extends parallel to the axis of the developing roller 10. As the gear 34*a*is driven by a drive motor (not shown), the rotation of the gear 34*a* is imparted to the developing roller 10 through the gear 23. In this manner, the drive line constituted by the motor and gears 23 and 34*a* drives the developing roller 10 at one end of the latter. As shown in FIG. 5, at the time when the rotation is transmitted from the drive gear 34*a* to the gear 23, a force F1 which is deviated from the common tangential direction of the gears 23 and 34*a* by the pressure angle is exerted by the gear 32*a* on the gear 23. Let this force F1 be called a tangential force, as mentioned earlier. The tangential force F1 acting on the developing roller 10 which is rotatable relative to the copier body urges the roller 10 toward the drum 1, i.e., a component of the tangential force F1 which is directed toward the drum 1 urges the roller 10 toward the drum 1. On the other hand, no driving force acts on the other end of the developing roller 10, so that the tangential force F1 acts on one end of the roller 10 only. As a result, the forces acting on opposite ends of the roller 10 are unbalanced to prevent the roller 20 from contacting the drum 1 with a uniform pressure.

While in the above arrangement the tangential force F1 urges the developing roller 10 toward the drum 1, a tangential force tending to urge the roller 10 away from the drum 1 is sometimes developed depending upon the meshing point of the gears 23 and 34*a* or the rotating direction of the roller 10. In the light of this, an alternative arrangement shown in FIG. 6 has been proposed in which the drive gear 34*a* is deviated by the pressure angle $\alpha$ of the gears from a line X which interconnects the centers of the drum 1 and roller 10, i.e., a direction in which the roller 10 presses the drum 1. In such a configuration, the tangential force F1 intersects the pressing direction at a right angle and does not act on the drum 1. Theoretically, therefore, the pressure acting between the drum 1 and the roller 10 can be maintained uniform along the axes of the drum 1 and roller 10. This is also true with a case wherein the drive gear 34*a* is located in a position labeled 34*b* in FIG. 6.

Figure 6:
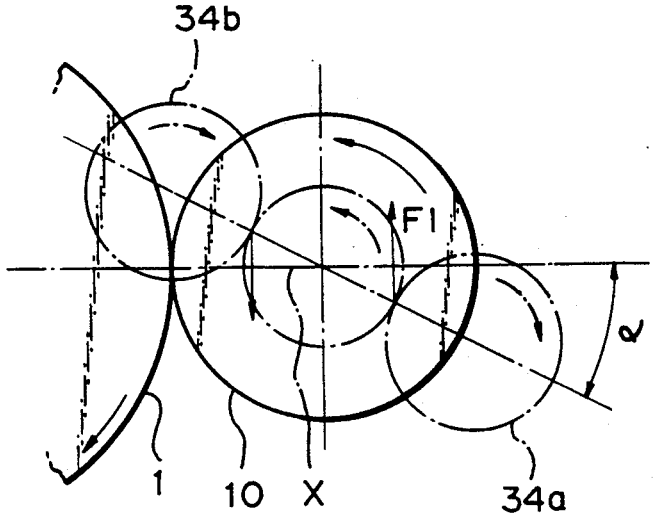
Fig. 6 PRIOR ART

However, the arrangement shown in FIG. 6 has a problem left unsolved, as discussed earlier. Specifically, when the torque of the developing roller 10 is relatively large or when the gear 34*a* or 34*b* is somewhat dislocated due to scattering in the event of assembly, a component of the tangential force F1 is exerted in the direction X to disturb the uniform contact of the roller 10 and drum 1. Theoretically, the uniform contact of the developing roller 10 and drum 1 is achievable by interconnecting the drive motor and roller 10 by an Oldham's coupling in place of a gear, as in the arrangement shown in FIG. 6. Nevertheless, should a developing roller shaft or a coupling member mounted on the copier body be dislocated, the uniform contact of the developing roller and drum would be effected.

Figure 7:
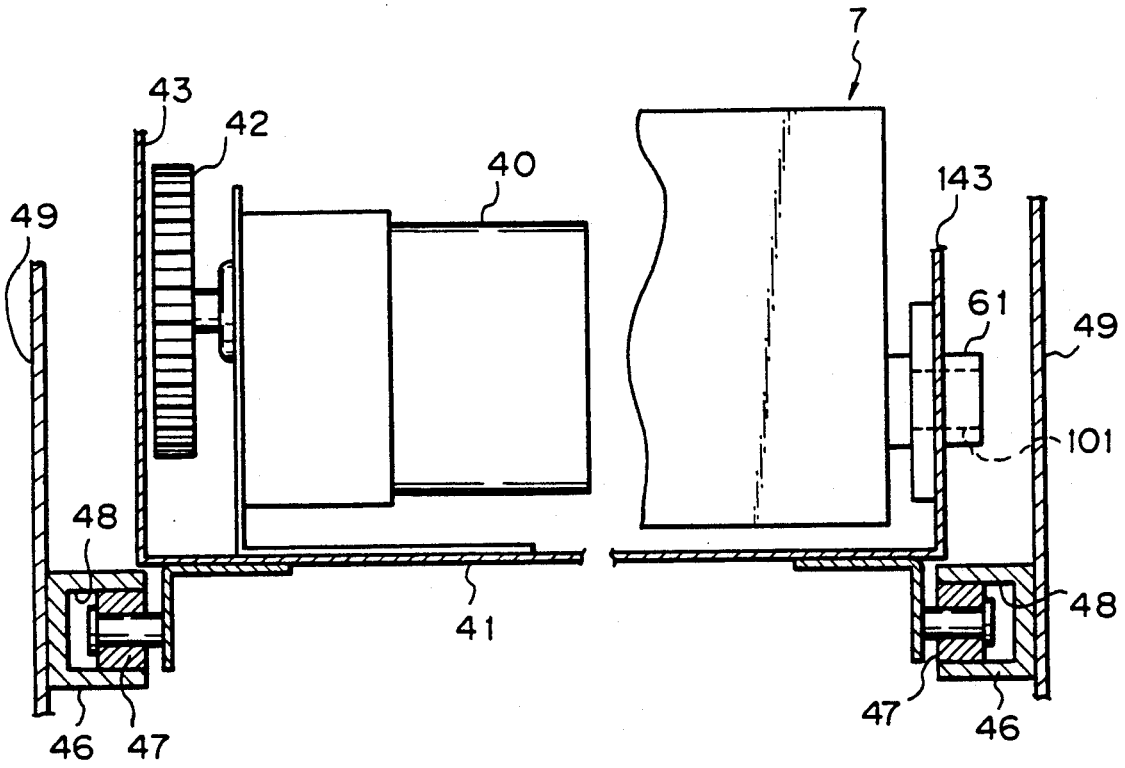

In the light of the above, as shown in FIGS. 1 and 2 as well as in FIG. 7, the illustrative embodiment has a carriage or base 41 on which the entire developing unit 7 and a drive motor 40 are securely mounted. The drive motor 40 is an example of drive sources applicable to the illustrative embodiment and has an output gear 42. A suitable number of intermediate gears, two gears 44 and 45 in this embodiment, are rotatably mounted on one of opposite side walls 43 of the carrier 41. The output gear 42 of the motor 40 is connected through the intermediate gears 44 and 45 to a gear 23 which is securely mounted on the developing roller shaft 100. More specifically, the output gear 42 is meshed with the first intermediate gear 44, the gear 44 is meshed with the second intermediate gear 45, and the gear 45 is meshed with the gear 23 of the developing roller 10. If desired, the output gear 42 may be directly meshed with the gear 23 of the developing roller 10 without the intermediary of the intermediate gears 44 and 45.

In the illustrative embodiment, opposite developing roller shafts 100 and 101 and a pair of support pins 60 which are studded on the toner container 8 are removably received in notches 62 and 53 which are formed in the base 41, as described in detail later. In this configuration, the developing unit 7 is unmovably supported by the base 41.

On the other hand, the carrier 41 is supported by the copier body in such a manner as to be movable toward and away from the drum 1. In the illustrative embodiment, four guide rollers 47 are rotatably mounted on the underside of the carrier 41, while a pair of spaced guide members 46 are individually formed with guide channels 48. Two of the guide rollers 47 are rollably received in one of the guide channels 48, and the other two in the other guide channel 48. The guide members 46 are individually rigidly mounted on a pair of side panels 49 (FIG. 7) which form a part of the framework of the copier body. The guide channels 48 extend perpendicularly to the axes of the drum 1 and developing roller 10 which are parallel to each other. As shown in FIG. 1, stubs 50 individually extend out from the framework of the copier body, e.g., from the opposite side panels 49. Pressing levers 51 are rotatably mounted on the individual stubs 50. A tension spring 52 is anchored at one end to one end of each pressing lever 51 and at the other end to the framework, while a pressing roller 53 is rotatably mounted on the other end of each pressing lever 51. The rollers 53 are constantly urged against a rear wall 54 of the carrier 41 by their associated springs 52, whereby the base 54 is constantly urged toward the drum 1. Hence, the developing roller 10 of the developing unit 7 which is unmovably mounted on the carriage 41 is pressed against the drum 1 by the springs 52.

The rotation of the drive motor 40 is transmitted to the gear 23 of the developing roller 10 by way of the gears 42, 44 and 45. As the roller 10 is rotated, the previously stated developing operation is performed. In this instance, it is noteworthy that the developing roller 10 is movable toward and away from the drum 1 together with the carrier 41 and is constantly biased by the springs 52. This allows the roller 10 to make pressing contact with the drum 1 even if the drum or the roller 10 is somewhat eccentric or undulated, by moving back and forth integrally with carrier 41 in the direction P of FIG. 1. Despite that the output of the motor 40 is applied to one end of the developing roller 10 via the gears 23 and 45, the tangential force (FIGS. 5 and 6) being exerted by the gear 45 on the roller 10 is born by the base 41 through the roller shaft 100 and support pins 60. This is because the drive line composed of the motor 40 and gears 42, 44, 45 and 23 is bodily mounted on the base 40. In this condition, the pressures acting on the drum 1 at opposite end portions of the developing roller 10 are prevented from being unbalanced, i.e., the tangential force is inhibited from moving the developing unit 7 relative to the drum 1.

As stated above, although the developing roller 10 is driven in a rotary motion at one end thereof only, the roller 10 is held in uniform contact with the drum 1 along its axis, and this condition is maintained with no regard to the torque of the roller 10. Hence, a desirable toner image which is free from local omission, irregular density distribution and background contamination is insured. Since the roller 10 is prevented from pressing itself against the drum 1 with an excessive force, the wear of the drum 1 is suppressed to increase the service life of the drum 1. The gear 23 of the developing roller 10 is drivably connected to the toner supply roller 11, agitator 9 and regulating roller 14 through gears (not shown) which are rotatably mounted on the toner container 8, so that the latter may rotate in response to the rotation of the gear roller 10.

Figure 8:
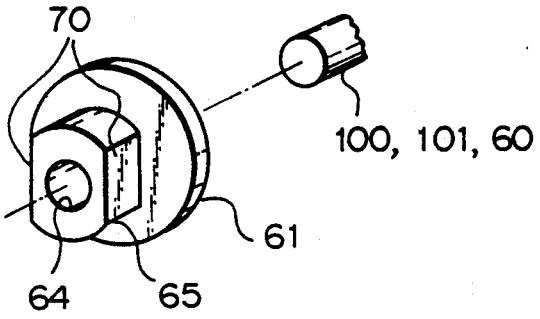
FIG. 8 is a peserspective view of a bearing member.
Figure 9:
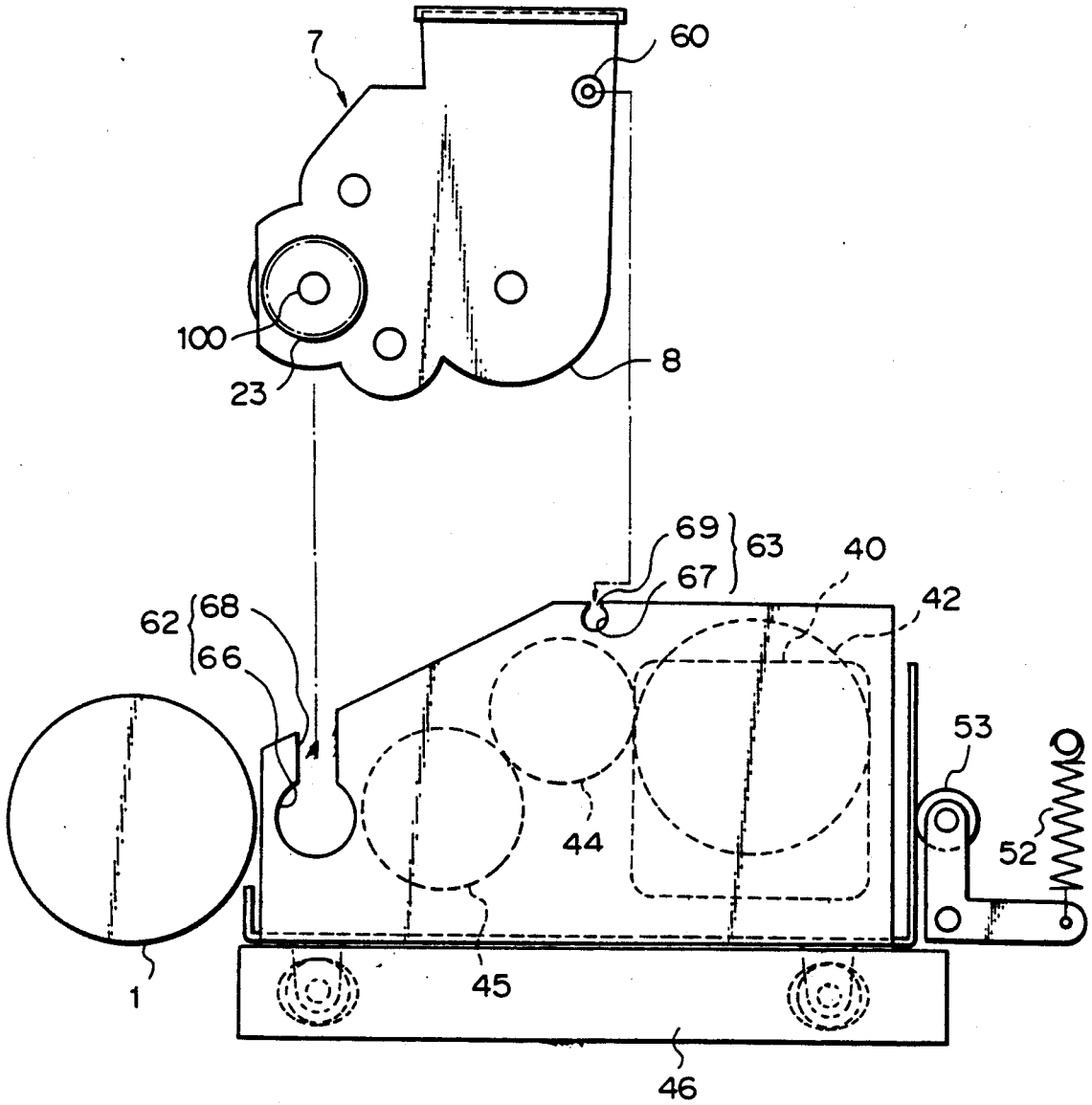
FIG. 9 is a front view of a base and a developing unit which is removed from the base.
Figure 10:
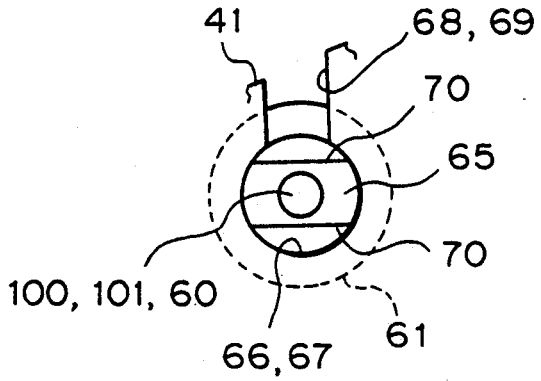
FIG. 10 is a view showing the bearing member which is received in a notch.

It is preferable that the developing unit 7 be removable from the copier body when its life expires or when it is to be replaced with another developing unit containing a toner of another color. To meet this need, the developing unit 7 is removably mounted on the carrier 41, as stated briefly earlier. Specifically, as shown in FIGS. 1, 2 and 8, the shafts 100 and 101 of the developing roller 10 and the support pins 60 are individually rotatably mated with center holes 64 of bearing members 61. Each bearing member 61 includes a boss 65 having a pair of radially opposite flat surfaces 70. In FIG. 2, the bearing member which is supported by one support pin 60 is not shown. As clearly shown in FIG. 9, the notches 62 and 63 formed in opposite side walls 43 and 143 of the carrier 41 as previously mentioned have respectively a circular portion 66 and a slit portion 68 and a circular portion 67 and a slit portion 69. The slit portions 68 and 69 merge into the circular portions 66 and 67, respectively. As shown in FIG. 10, while the developing unit 7 is mounted on the carrier 41, the boss 65 of each bearing member 61 is received in the circular portion 66 or 67 of the associated notch 62 or 63 with the flat surfaces 70 thereof being not aligned with the slit portion 68 or 69. In this condition, the developing unit 7 is not movable although rotatable relative to the base 41.

When the bearing members 61 are rotated 90 degrees from the position shown in FIG. 10 to align the flat surfaces 70 of the bosses 65 with the notches 62 and 63, the developing unit 7 can be removed from the base 41 simply by raising it. By the reverse procedure, the developing unit 7 may be unmovably loaded on the base 41. In the illustrative embodiment, when the developing unit 7 is removed as stated, the drive motor 40 is left on the base 41. This allows the developing unit 7 to be readily removed alone and allows only the developing unit 7 having reached its life to be discarded.

In summary, the second rotary body in the form of the developing roller 10 and the drive source in the form of the drive motor 40 are unmovably mounted on the carrier or base 41. The carrier 41 is supported in such a manner as to be movable toward and away from the drum 1 which is a specific form of the first rotary body. The developing roller 10 is pressed against the drum 10 by biasing means which are implemented as the springs 52. The developing roller 10 is removably mounted on the carrier 41. Such a construction offers the above-described advantages associated with the removal of the developing unit 7.

However, the present invention is not limited to the embodiment shown and described. An alternative construction is such that the motor 40 and developing roller 10 are assembled integrally with each other, the subassembly is supported to be movable toward and away from the drum 1, and the roller 10 is pressed against the drum 1 by the springs 52. This also insures uniform contact of the roller 10 and drum 1. In this case, the base 41 is omissible. For example, the developing unit 7 and motor 40 may be constructed into a single unit, and this unit may be mounted either slidably or rotatably on the copier body.

Figure 11:
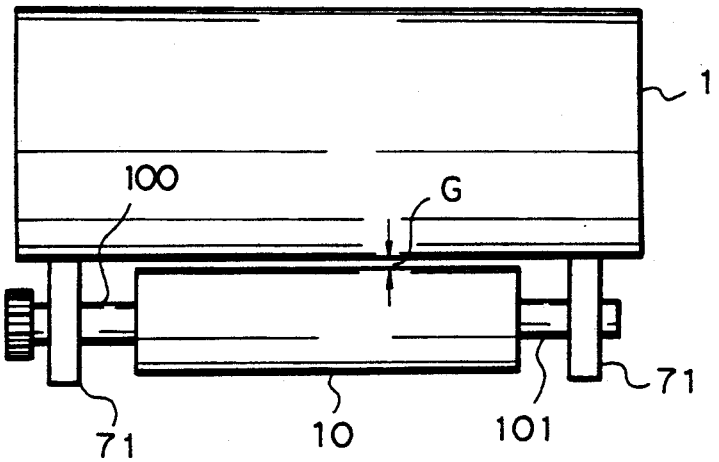
FIG. 11 is a plan view of an alternative arrangement of a developing roller and a photoconductive drum.

FIG. 11 indicates another type of developing arrangement which is available for so-called non-contact development. As shown, spacer rollers 71 having the same diameter are respectively rigidly mounted on the developing roller shafts 100 and 101 and held in contact with the drum 1. That part of the developing roller 10 which contributes to the development is spaced apart from the drum 1 by a predetermined gap G. The present invention is practicable with this type of developing arrangement also. Should the spacer rollers 71 be pressed against the drum with a non-uniform pressure distribution, the drum 1 would cause jitter due to vibration or the gap G would become non-uniform, degrading the quality of a toner image.

When the developing roller 10 and the drum 1 are spaced apart by a gap G as stated above, use can be made of a two-component developer which consists of a toner and a carrier.

In the illustrative embodiment, the gears 42, 44 and 45 which are driven by the drive motor 40 may be replaced with any other suitable torque transmitting members such as a belt and pulleys.

Advantageously, in order that the drum 1 and developing roller 10 may press against each other uniformly and, yet, with some margin, the roller 10 may be provided with a surface layer made of an elastic material having rubber hardness of the order of 30 degrees, e.g. NBR rubber or urethane rubber. When the roller 10 having such a surface layer is pressed against the drum 1, the surface layer will be deformed by several ten microns to 100 microns, for example. With the prior art construction, it is difficult to maintain the uniform pressure distribution even when a developing roller having the above-mentioned surface layer is used. The present invention is of course practicable even if the drum 1 has an elastically deformable surface layer also or if both the drum 1 and the roller 10 have a rigid surface layer.

In the illustrative embodiment, the first rotary body rotatably supported by a machine body is implemented as a photoconductive drum, the second rotary body movable toward and away from the first rotary body is implemented as a developing roller, and a driving device of the type driving the developing roller at one end of the latter is used. It is to be noted, however, that the present invention can be implemented as a driving device associated with any other kind of machine or portion. For example, the present invention is applicable to a driving device for driving the second rotary body which is the charge roller 5, transfer roller 15 or cleaning roller 18 shown in FIG. 1, in which case the drum 1 will serve as the first rotary body. Conversely, the drum 1 may be movably supported to serve as the second rotary body and driven by the driving device, in which case the roller 10, 5, 12 or 18 will serve as the first rotary body and be held unmovably. This also holds true with the developing roller 10 and regulating roller 14, the developing roller 10 and toner supply roller 11, etc. The second rotary member may be comprised of a fur brush. Further, the present invention is applicable to a printer in which the first rotary body in the form of an offset roller is pressed against the second rotary body which is implemented as an ink roller. The toner container 8 used to support the second rotary body in the illustrative embodiment will be suitably changed to match a particular application.

In summary, it will be seen that the present invention substantially frees the first and second rotary bodies from the influence of the transmission of rotation on their contact pressure despite a simple construction thereof. In addition, the second rotary body or a support member which is loaded with the second rotary body can be mounted and dismounted from a machine body which is independent of a drive source.

Various modifications will become possible for those skilled in the art after receiving the teachings of the present disclosure without departing from the scope thereof.

What is claimed is:

1. A device for driving a second rotary body in a rotary motion by transmitting a driving force from a drive source to said second rotary body, comprising:

a first rotary body rotatably supported by a body of a machine for rotation about a first rotary body axis of rotation;

a movable carrier on which said drive source is securely mounted and said second rotary body is rotatably mounted, by rotatable mounting means, for rotation about a second rotary body axis of rotation, said movable carrier being movable toward and away from said first rotary body, the driving force of said drive source being applied to one end of said second rotary body and exerting a tangential force thereon which is borne by said movable carrier through said rotatable mounting means to prevent opposite ends of said second rotary body from moving relative to said movable carrier;

guide means for guiding said movable carrier toward and away from the first rotary body along a predetermined path which positions the second rotary body axis of rotation substantially parallel to the first rotary body axis of rotation; and biasing means for biasing said movable carrier toward said first rotary body so that said second rotary body is held in uniform pressing contact with said first rotary body.

2. A device as claimed in claim 1, wherein said second rotary body is removably mounted on said movable carrier.

3. A device as claimed in claim 1, wherein said machine comprises an image forming apparatus.

4. A device as claimed in claim 3, wherein said first rotary body comprises an image carrier in the form of a drum, said second rotary body comprising a developing roller.

5. A device as claimed in claim 3, wherein said first rotary body comprises an image carrier in the form of a drum, said second rotary body comprising one of a charge roller, a transfer roller, and a cleaning roller.

6. A device as claimed in claim 4, wherein said first rotary body comprises either one of a pair of fixing and pressing rollers constituting an image fixing unit, said second rotary body comprising the other of said pair of fixing and pressing rollers.

7. A device as claimed in claim 1, wherein said movable carrier is mounted on rollers which are guided by said guide means.

8. A device for driving a developing roller in a rotary motion by transmitting a driving force from a drive source to said developing roller in an image forming apparatus, comprising:

an image carrier in the form of a drum rotatably supported by a body of said image forming apparatus;

a movable carrier on which said drive source is unremovably mounted and said developing roller is removably mounted such that said developing roller is elastically pressed against said drum, said movable carrier being movable toward and away from said drum, the driving force of said drive source being applied to one end of said developing roller; and biasing means for biasing said movable carrier toward said drum so that said developing roller is held in uniform pressing contact with said drum.

9. A device as claimed in claim 8, wherein said developing roller is provided with a surface layer made of an elastic material.

10. A device as claimed in claim 8, wherein the driving force is applied to only one end of said developing roller.

* * * * *